US005236208A

United States Patent [19]

Welsh

[11] Patent Number: 5,236,208

[45] Date of Patent: Aug. 17, 1993

[54] PLATFORM STEERABLE SKATEBOARD

[76] Inventor: Thomas Welsh, 3672 Pringle St., San Diego, Calif. 92110

[21] Appl. No.: 880,182

[22] Filed: May 7, 1992

Related U.S. Application Data

[63] Continuation-in-part of Ser. No. 754,011, Sep. 3, 1991, abandoned.

[51] Int. Cl.[5] ..... A63C 17/01

[52] U.S. Cl. ..... 280/87.041; 280/87.1; 280/11.27

[58] Field of Search ..... 280/87.042, 87.041, 280/87.01, 87.043, 47.11, 87.1, 86, 92, 91, 96.3, 11.27

[56] References Cited

U.S. PATENT DOCUMENTS

| | | | |
|---|---|---|---|
| 1,273,593 | 7/1918 | Felicitti | 280/87.1 |
| 2,055,747 | 9/1936 | Laube et al. | 280/87.01 |
| 3,035,849 | 5/1962 | Groth | 280/87.01 |
| 3,567,242 | 3/1971 | Miller | 280/87.041 |
| 3,771,811 | 11/1973 | Bueno | 280/87.042 |
| 4,202,559 | 5/1980 | Piazza | 280/87.042 |
| 4,445,699 | 5/1984 | Darasko | 280/87.041 |

FOREIGN PATENT DOCUMENTS

| | | | |
|---|---|---|---|
| 0959743 | 4/1950 | France | 280/87.042 |
| 1405865 | 6/1988 | U.S.S.R. | 280/87.041 |

*Primary Examiner*—David M. Mitchell
*Attorney, Agent, or Firm*—Calif Kip Tervo

[57] ABSTRACT

A fully steerable skateboard generally comprises an elongate chassis rollingly supported by a pair of front wheels and a pair of rear wheels. Each wheel rotates about a substantially horizontal axis for rollingly supporting the chassis and rotates about a vertical axis for steering the chassis. A steering mechanism attached to the chassis and to the wheels steers the wheels in response to movement of a rider's foot. The wheels at all times define a stable support plane for said skateboard. Each said wheel is rotatable through 360 degrees. Braking is accomplished by rotating a wheel set ninety degrees to the direction of travel. According to a preferred embodiment, the wheel steering mechanism includes a pair of foot platforms for supporting a rider's feet. Steering linkage connects each foot platform to a set of wheels such that rotation of each foot platform steers the wheels. The chassis has an underside that forms a plane such that obstacles can only strike a wheel below its axle.

20 Claims, 5 Drawing Sheets

FIG. 1
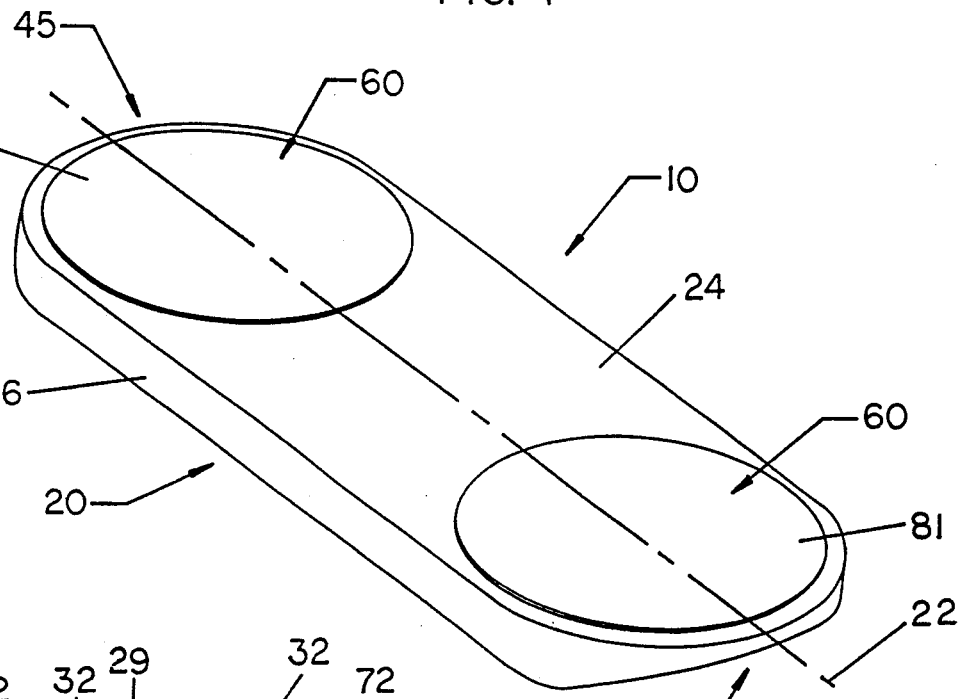
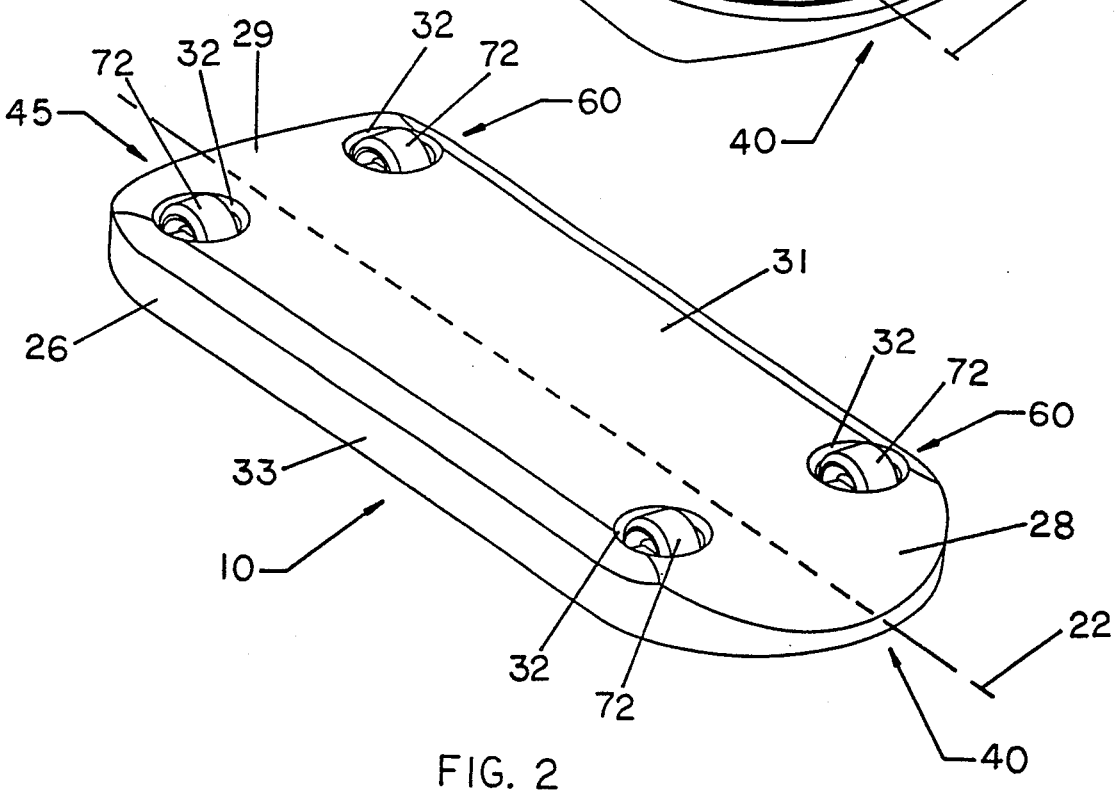
FIG. 2

PLATFORM STEERABLE SKATEBOARD

REFERENCE TO RELATED APPLICATION

This application is a continuation-in-part of co-pending application Ser. No. 754,011 titled SKATEBOARD filed Sep. 3, 1991 and now abandoned.

BACKGROUND OF THE INVENTION

Field of the Invention

This invention relates in general to skateboards and more particularly involves a skateboard that has fully rotational steerable wheels and that still provides a stable riding platform. A bottom hull allows the skateboard to ride over obstacles.

Description of the Related Art

Conventional skateboards can not turn sharply unless the rider lifts the wheels from the ground. Conventional skateboards can not be propelled well without removing a foot from the skateboard. Conventional skateboards have inadequate braking methods. Conventional skateboards will not ride over obstacles that are about axle height or higher. Conventional skateboards cannot be ridden sideways.

Therefore, it is desirable to have an improved skateboard that will turn much more responsively.

It is desirable to have a skateboard that has superior braking characteristics.

It is desirable that such as skateboard can be ridden sideways and backward.

It is desirable to have a skateboard that can be propelled with both feet on the skateboard.

It is further desirable that such a skateboard be able to ride over horizontal obstacles higher than the wheel axles.

SUMMARY OF THE INVENTION

This invention is a skateboard that can be steered such that it can travel in any orientation and that can be propelled with the rider's feet on the skateboard. The skateboard generally comprises an elongate chassis rollingly supported by a pair of front wheels and a pair of rear wheels. Each wheel rotates about a substantially horizontal axis for rollingly supporting the chassis and rotates about a vertical axis for steering the chassis. A steering mechanism attached to the chassis and to the wheels steers the wheels in response to rotation of a rider's foot. The wheels at all times define a stable support plane for said skateboard. Each said wheel is rotatable through 360 degrees.

According to a preferred embodiment, the wheel steering mechanism includes a pair of foot platforms for supporting a rider's feet. Steering linkage connects each foot platform to a set of wheels such that rotation of the foot platform steers the wheels.

According to a further aspect of the invention the chassis has an underside that forms a plane such that obstacles can only strike a wheel below the wheel's horizontal axis.

Other features and many attendant advantages of the invention will become more apparent upon a reading of the following detailed description together with the drawings in which like reference numerals refer to like parts throughout.

BRIEF DESCRIPTION OF THE DRAWING

FIG. 1 is a top perspective view of the preferred embodiment of the skateboard of the invention.

FIG. 2 is a bottom perspective view of the skateboard of FIG. 1.

DETAILED DESCRIPTION OF THE INVENTION

Figure 6:
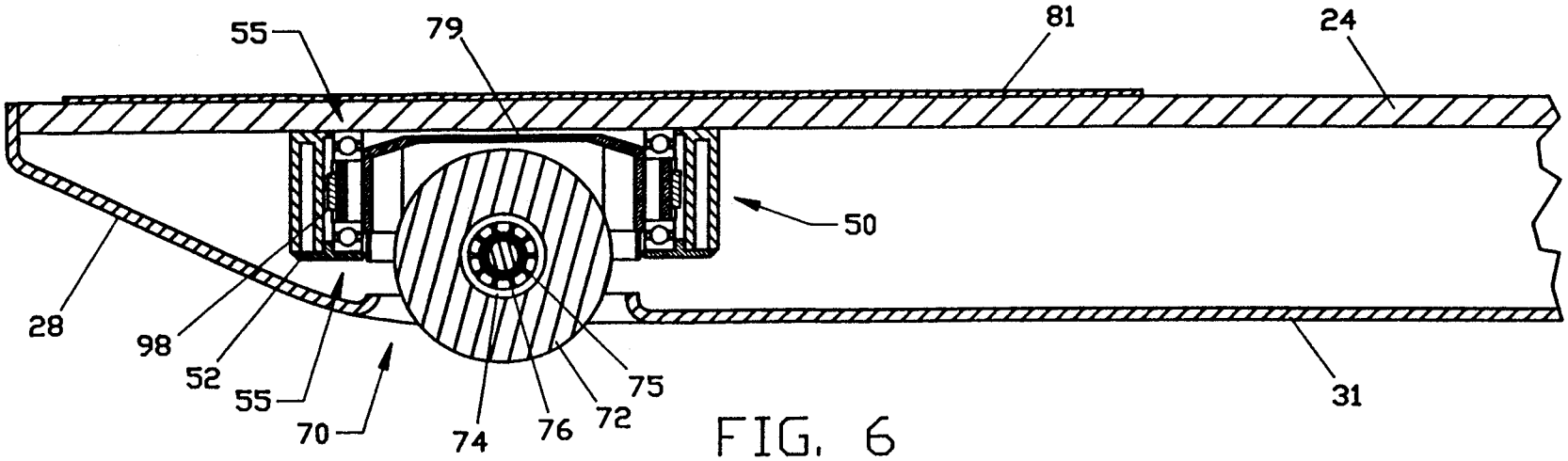
FIG. 6 is a sectional view taken on line 6—6 of FIG. 4.

With reference now to the drawings, and more particularly FIG. 1 thereof, there is shown a top perspective view of a preferred embodiment of the skateboard, denoted generally as 10, of the invention. Skateboard 10 generally comprises an elongate chassis, denoted generally as 20, having a front end 40 and rear end 45. Chassis 22 has a longitudinal axis 22 passing from front end 40 to rear end 45. Chassis 20 includes a top deck 24 and bottom hull 26.

A steerable wheel assembly means, denoted generally as 60, attached to chassis 20 at each end 40,45, includes a foot platform 81 for supporting a user's foot.

FIG. 2 is a bottom perspective view of the skateboard 10 of FIG. 1. Bottom hull 26 generally covers the bottom of skateboard 10 and has a front end slanted portion 28 and a rear end slanted portion 29 leading downward from deck 24 to join a generally flat central portion 31. Hull side wall 33 is connected to deck 24. Openings 32 in the bottom of hull 26 accommodate wheels 72. In general, hull 26 provides a continuous, smooth bottom surface to skateboard 10. The steerable wheel assemblies 60 include steerable wheels 72 which protrude through hull openings 32 for rollingly supporting and steering skateboard 10. The fixed, spaced apart wheels 72 define a plane for stably supporting skateboard 10 at all times.

Figure 3:
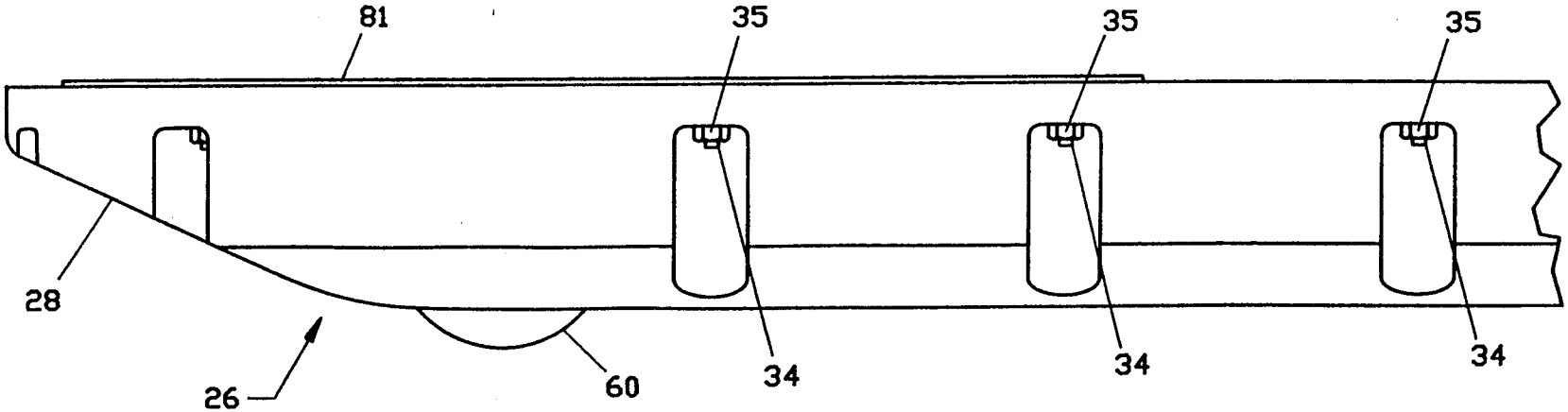
FIG. 3 is side elevation view of the front half of the skateboard of FIG. 1, the rear half being a mirror image.

FIG. 3 is side elevation view of the front half of the skateboard 10 of FIG. 1, the rear half being a mirror image. Hull 26 includes front slant portion 28 and central flat portion 31. Hull side wall 33 is connected to deck 24 by any suitable means, such as bolts 34 and nuts 35. It is intended that hull 26 be easily replaceable should it incur damage. Wheel 72 protrudes partially out of hull 26. Hull 26 extends downward sufficiently such that any obstacles encountered by the moving skateboard 10 can only strike the wheels 72 well below their axles. Foot platform 80 protrudes slightly above the level of deck 24.

Figure 4:
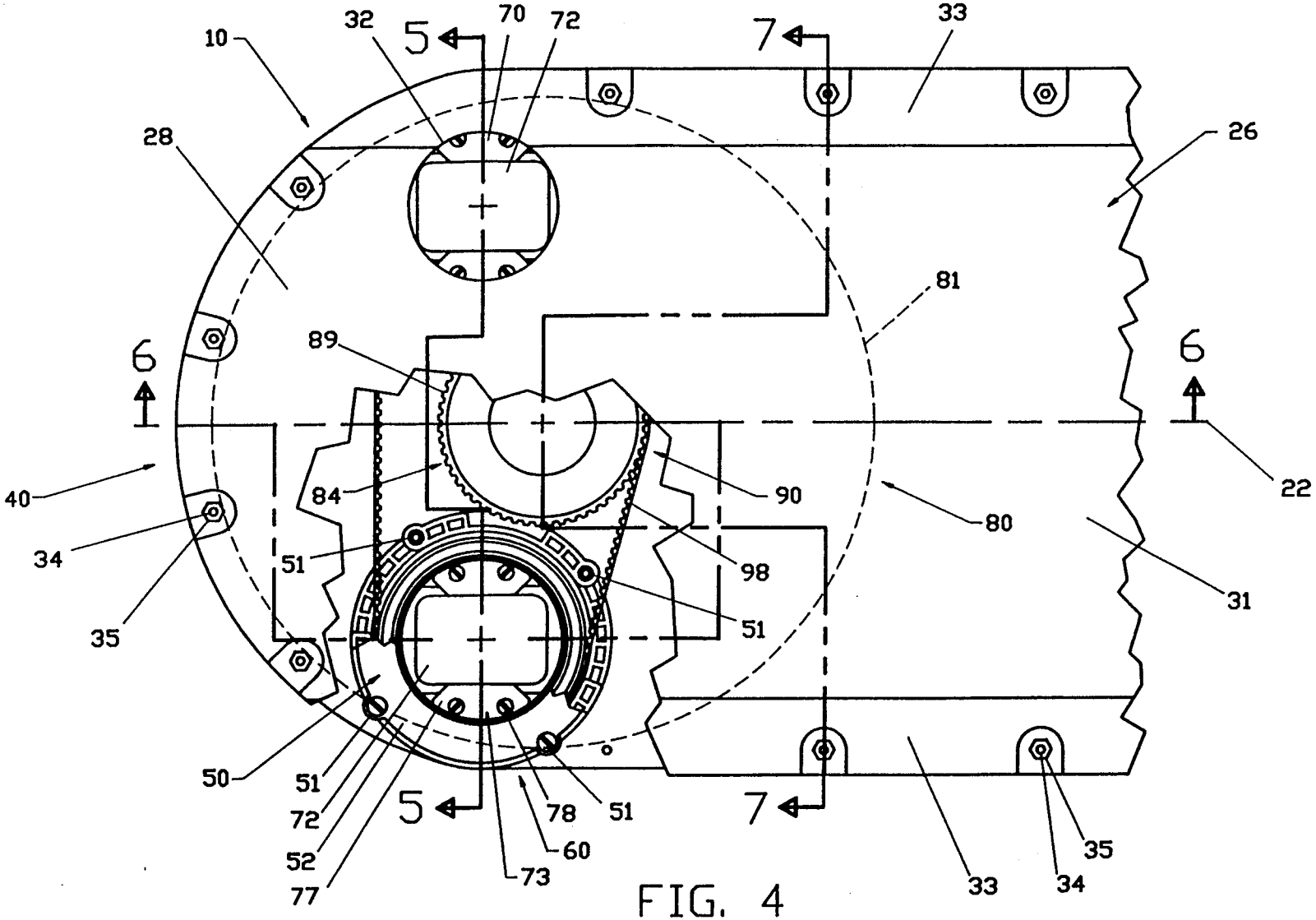
FIG. 4 is a partially cut away enlarged bottom plan view of the front half of the skateboard of FIG. 1, the rear half being a mirror image.

FIG. 4 is a partially cut away enlarged bottom plan view of the front half of the skateboard 10 of FIG. 1, the rear half being a mirror image. Hull 26 includes slanted lead-in portion 28 at the skateboard front end 40, central flat section 31, and side walls 33. Fasteners, such as bolts 34 and nuts 35, connect hull side wall 33 to deck 24. Hull openings 32 accommodate wheels 72.

Hull 26 is partially cut away to show chassis members including a front wheel steering journal, denoted generally as 50, having a substantially vertical axis. Journal 50 is attached to chassis 20. In the preferred embodiment shown, journal 50 is attached to deck 24 by fasteners 51 which pass through a journal cover 52. Journal cover 52 is shown partially cut away to show steering belt 98. Wheel journal 50 will be further described with respect to FIGS. 5 and 6. Each end of skateboard 10 has a pair of side to side spaced apart wheel steering journals 50. A steerable wheel assembly means, denoted generally as 60, is attached to each end of chassis 20 for steeringly rollingly supporting skateboard 10.

Each steerable wheel assembly means 60 generally includes a pair of wheel assemblies, denoted generally as 70, and a steering mechanism, denoted generally as 80.

Each wheel assembly 70 includes a wheel 72 having a substantially horizontal axis and wheel mounting means, denoted generally as 73, for mounting wheel 72 to wheel journal 50 such that wheel 72 may rotate about its horizontal axis for rollingly supporting skateboard 10 and such that wheel 72 may rotate about the vertical axis of wheel journal 50 for steering skateboard 10.

Each steering mechanism includes foot platform 81, shown in dashed lines, for supporting a user's foot and includes steerage linkage means, denoted generally as 90, connected to foot platform 81 and to wheel assemblies 70 such that rotation of foot platform 81 steers wheels 72 by rotating each about the vertical axis of its wheel journal 50. Steerage linkage means 90 includes a steering pulley, denoted generally as 84, attached to foot platform 81 which is shown in dashed lines, and belt 98. Preferably, pulley 84 has teeth on its outer surface and belt 98 is correspondingly matingly toothed on its inner surface.

Figure 5:
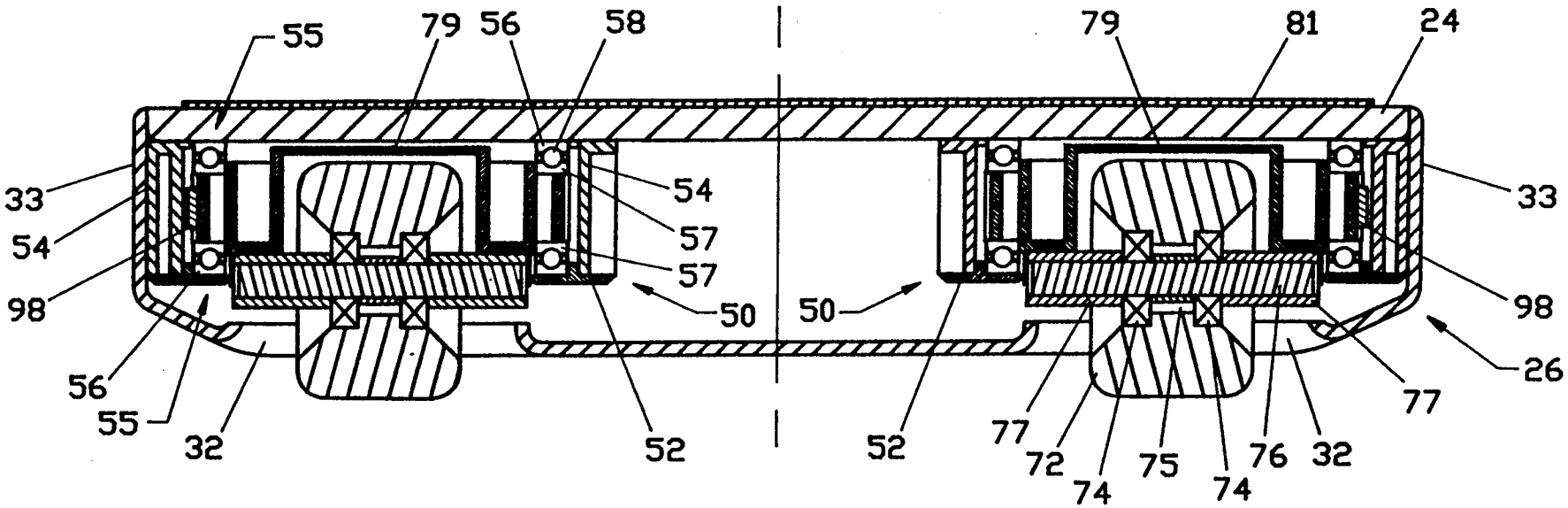
FIG. 5 is a sectional side elevation taken on line 5—5 of FIG. 4 and inverted to correspond with FIG. 3.

FIG. 5 is a sectional view taken on line 5—5 of FIG. 4. Chassis 20 includes deck 24, hull 26 and wheel steering journals 50. Hull 26 includes central flat portion 31, wheel openings 32, and side walls 33. Wheel steering journals 50 include a race housing 54 housing the outer races 56 of circular bearings 55. The inner races 57 of circular bearings 55 are free to rotate on whatever type of bearing is used, such as ball bearings 58.

In the preferred embodiment, wheel assembly 70 generally includes wheel 72 and wheel mounting means 73 including wheel bearings 74, bearing spacer 75, axle 76, axle block 77, and wheel housing 79. Wheel roller bearings 74 freely rotationally mount wheels 72 to axle 76 in a manner well known in the art. Bearing spacer 75 retains wheel bearing in position. Axle block 77 encloses axle 76 and attaches the ends of axle 76 by means such as screw fasteners 78 (see FIG. 4) to wheel housing 79. Wheel housing 79 includes outer flanges 71 that are supported by the inner races of circular bearing 55. Preferably, wheels 62 are fully steeringly rotatable through 360 degrees.

The outer surface of wheel housing outer flanges 71 is toothed to receive steering belt 98. Upon assembly, first, the upper bearing of circular bearings 55 is inserted into race housing 54. Then wheel assembly 70 is inserted, followed by placement of steering belt 98 and the lower of circular bearings 55. All is held in place by journal cover 52.

In this manner, the whole wheel assembly 70 is rotatable in bearings 55 about the journal vertical axis for steering skateboard 10.

FIG. 6 is a sectional view taken on line 6—6 of FIG. 4 and passes vertically longitudinally through the middle of wheel journal 50 and wheel assembly 70. Wheel 72, wheel axle 76, and bearing spacer 75 are seen. FIG. 6 is quite similar to FIG. 5, the description of which can be turned to for review of the other elements.

Figure 7:
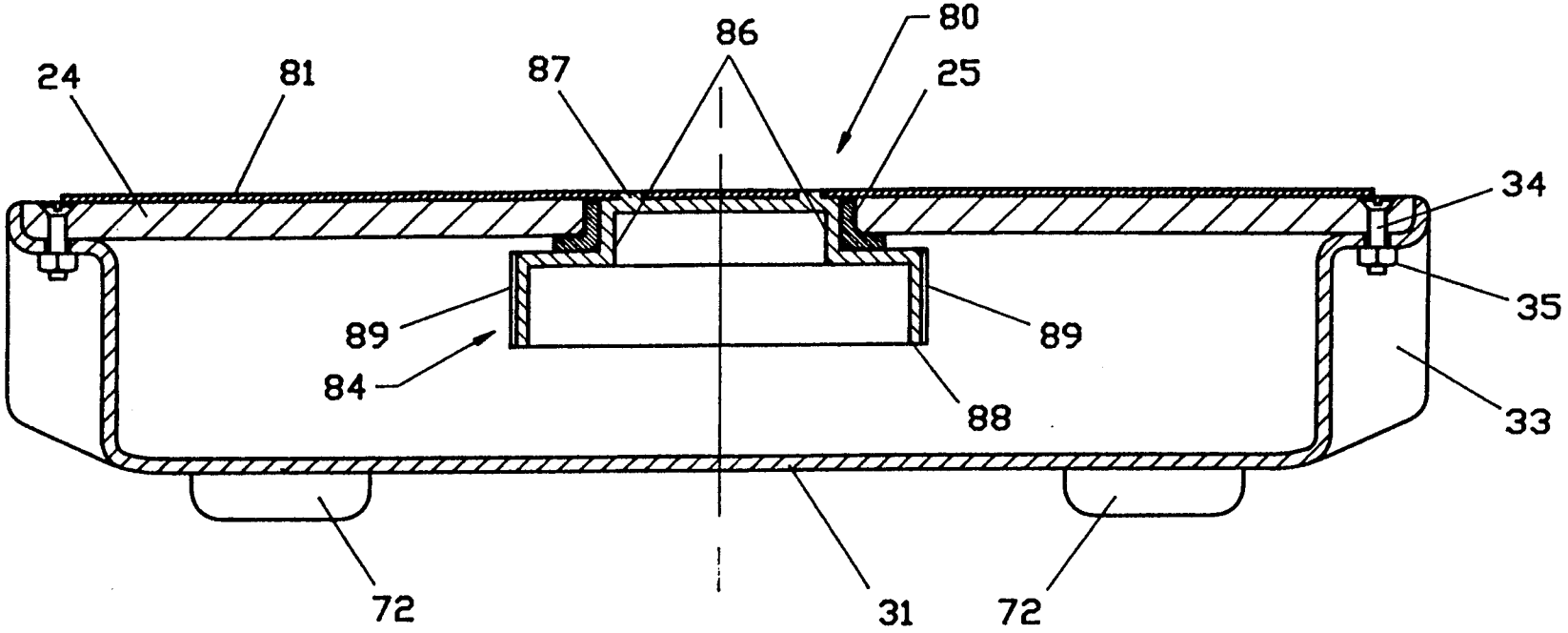
FIG. 7 is a sectional view taken on line 7—7 of FIG. 4.

FIG. 7 is a sectional view taken on line 7—7 of FIG. 4 better showing the wheel steering mechanism 80. A deck journal 25 having a substantially vertical axis is mounted in top deck 24. Wheel steering mechanism 80 generally comprises foot platform 81 and steerage linkage means connecting foot platform 81 to wheel assemblies 70 such that rotation of foot platform 81 steers wheels 72. The steering linkage means includes steering pulley 84 and steering belt 98.

Foot platform 81 is mounted on chassis 20 such that it freely rotates. In the preferred embodiment shown, foot platform 81 is made of teflon plastic and rotates by sliding on deck 24. Other configurations are contemplated, such as having a stronger, more rigid platform that rotates on a bearing race in deck 24.

Steering wheel pulley 84 includes a bearing portion 86 rotatably mounted in deck journal 25, a top end 87 attached to foot platform 81 and a bottom end 88 having a toothed periphery 89 for interaction with steering belt 98. Rotation of foot platform 81 rotates pulley 84.

Steering belt 98 is preferably a flexible belt of any suitable material, such as rubber, and has a toothed inner surface. Belt 98 wraps partially around the toothed outer periphery 89 of pulley bottom end 88 and partially around the toothed outer periphery of wheel housings 79. Rotation of pulley 84 rotates wheel housing 79 and, thus, wheels 72. In the preferred embodiment, the diameter of pulley periphery 89 is the same as the toothed periphery of wheel housings 79 such that angular displacement of foot platform 81 equals that of wheels 72.

Other steering linkage mechanisms are contemplated. For example any of several gearing systems can link foot platform 81 with wheels 72. A single foot platform could be linked to steer all of the wheels. The steering ratio between foot platform and wheels can be adjusted by changing pulley diameters or gear ratios to change the sensitivity of the steering. The steerable wheel assemblies may include a biasing means for biasing the wheels in the "forward" direction.

The skateboard 10 of the invention can be braked by temporarily de-weighting an end, rotating that end's wheels to travel in a direction ninety degrees to the board's direction of travel, and re-weighting the rotated wheels.

Having described the invention, it can be seen that it provides for a skateboard that can be steered sharply in any direction. The wheels are fully rotatable through 360 degrees such that the skateboard can travel sideways and backwards. The wheels, at all times, define a support plane so that the skateboard is a stable riding platform. The skateboard can be ridden in a "cocked" or "crabbed" configuration, i.e. with the longitudinal axis of the board not pointed in the direction of board travel.

The lower hull allows the skateboard to ride or slide over many obstacles, such as stairs and curbs. The skateboard can ride over horizontal obstacles, such as stairs.

Although a particular embodiment of the invention has been illustrated and described, various changes may be made in the form, composition, construction, and arrangement of the parts without sacrificing any of its advantages. Therefore, it is to be understood that all matter herein is to be interpreted and illustrative and not in any limiting sense and it is intended to cover in the appended claims such modifications as come within the true spirit and scope of the invention.

I claim:

1. A skateboard comprising:

a chassis including;

a front end; and a rear end;

each end including:

a pair of side to side spaced apart wheel steering journals, each said wheel steering journal having a substantially vertical axis;

a steerable wheel assembly means for each said end; each steerable wheel assembly means attached to its said chassis end for steeringly rollingly supporting its said chassis end; each said steerable wheel assembly comprising:

a wheel assembly, including a wheel, for each said wheel steering journal; each said wheel having a substantially horizontal axis; each said wheel assembly mounted to its said wheel steering journal such that its said wheel may rotate about said wheel horizontal axis for rollingly supporting said skateboard and such that said wheel may rotate about its said wheel steering journal vertical axis for steering said skateboard; and a wheel steering mechanism including:

a foot platform for supporting a user's foot; said foot platform rotationally mounted on said chassis;

steering linkage means connecting said foot platform to said wheels such that rotation of said foot platform steers said wheels.

2. The skateboard of claim 1 wherein:

each said wheel is steerable through 360 degrees.

3. The skateboard of claim 1 wherein:

each said wheel assembly includes a substantially horizontal axle and each said wheel is rotationally mounted on its said axle.

4. The skateboard of claim 3 wherein:

each said axle is mounted to its said wheel steering journal such that said axle and its said wheel may rotate about its said wheel steering journal vertical axis for steering said skateboard.

5. The skateboard of claim 1 wherein:

each said chassis end includes:

a deck journal; and each said wheel steering mechanism is rotationally mounted to its said chassis end deck journal.

6. The skateboard of claim 1 wherein:

said chassis has an underside that forms a plane such that obstacles can only strike a said wheel below said wheel's horizontal axis.

7. A skateboard comprising:

a chassis having:

a front end; and a rear end;

a longitudinal axis between said front and rear ends;

a first journal having a substantially vertical axis on a first side of said longitudinal axis and;

second journal having a substantially vertical axis on a second side of said longitudinal axis;

a front wheel assembly means attached to said chassis front end for rollingly supporting said chassis front end;

a rear wheel assembly means attached to said chassis rear end for rollingly supporting said chassis rear end; at least one of said wheel assembly means being steerable and comprising:

a first rolling support wheel including a substantially horizontal axle having a longitudinal axis; said first wheel axle mounted to said first journal such that said first wheel axle longitudinal axis may rotate to steer said first wheel;

a second rolling support wheel including a substantially horizontal axle having a longitudinal axis; said second wheel axle mounted to said second journal such that said second wheel axle longitudinal axis may rotate to steer said second wheel;

a wheel steering mechanism including:

a foot platform for supporting a user's foot; said foot platform rotationally mounted on said chassis;

steering linkage means connecting said foot platform to said first and second support wheels such that rotation of said foot platform steers said first and second wheels.

8. The skateboard of claim 7 wherein:

said first rolling support wheel is rotationally mounted on its said axle; and said second rolling support wheel is rotationally mounted on its said axle.

9. The skateboard of claim 7 wherein:

said chassis includes:

a deck journal; and said wheel steering mechanism is rotationally mounted to its said chassis end deck journal.

10. The skateboard of claim 7 wherein:

said chassis has an underside that forms a plane such that obstacles can only strike a said wheel below said wheel's horizontal axis.

11. A skateboard comprising:

a chassis including;

a longitudinal axis between a front and a rear end;

a front end including:

a first front end journal having a substantially vertical axis on a first side of said longitudinal axis and;

a second front end journal having a substantially vertical axis on a second side of said longitudinal axis;

a rear end including:

a first rear end journal having a substantially vertical axis on a first side of said longitudinal axis and;

a second rear end journal having a substantially vertical axis on a second side of said longitudinal axis;

a front steerable wheel assembly means attached to said chassis front end for rollingly supporting and steering said chassis front end including:

first front wheel assembly means, including a first front wheel, for rollingly supporting said chassis; said first front wheel having a substantially horizontal axis; said first front wheel assembly means mounted to said first front journal such that said first front wheel ma rotate about said first front wheel horizontal axis for transporting said skateboard and such that said first front wheel may rotate about said first front journal vertical axis for steering said skateboard;

second front wheel assembly means, including a second front wheel, for rollingly supporting said chassis; said second front wheel having a substantially horizontal axis; said second front wheel assembly means mounted to said second front journal such that said second front wheel may rotate about said second front wheel horizontal axis for transporting said skateboard and such that said second front wheel may rotate about said second front journal vertical axis for steering said skateboard; and a front wheel steering mechanism including:

a front foot platform for supporting a user's foot; said foot platform rotationally mounted on said chassis;

front steering linkage means connecting said front foot platform to said first and second front wheels such that rotation of said front foot platform steers said first and second front wheels; and a rear steerable wheel assembly means attached to said chassis rear end for rollingly supporting and steering said chassis rear end including:

first rear wheel assembly means, including a first rear wheel, for rollingly supporting said chassis; said first rear wheel having a substantially horizontal axis; said first rear wheel assembly means mounted to said first rear journal such that said first rear wheel may rotate about said first rear wheel horizontal axis for transporting said skateboard and such that said first rear wheel may rotate about said first rear journal vertical axis for steering said skateboard;

second rear wheel assembly means, including a second rear wheel, for rollingly supporting said chassis; said second rear wheel having a substantially horizontal axis; said second rear wheel assembly means mounted to said second rear journal such that said second rear wheel may rotate about said second rear wheel horizontal axis for transporting said skateboard and such that said second rear wheel may rotate about said second rear journal vertical axis for steering said skateboard; and a rear wheel steering mechanism including:

a rear foot platform for supporting a user's foot; said rear foot platform rotationally mounted on said chassis;

rear steering linkage means connecting said rear foot platform to said first and second rear wheels such that rotation of said rear foot platform steers said first and second rear wheels.

12. The skateboard of claim 11 wherein:

each said first and second front and rear wheels is rotationally mounted on its said axle.

13. The skateboard of claim 12 wherein:

each said first and second front and rear wheel axle is mounted to its said wheel steering journal such that said axle and its said wheel may rotate about its said wheel steering journal vertical axis for steering said skateboard.

14. The skateboard of claim 11 wherein:

each said wheel is steeringly rotatable through 360 degrees.

15. The skateboard of claim 11 wherein:

said chassis has an underside that forms a plane such that obstacles can only strike a said wheels below each said wheel's horizontal axis.

16. A skateboard comprising:

a chassis;

at least three wheel means attached to said chassis for rollingly supporting and steering said chassis and at all times defining a support plane for said skateboard; each said wheel means including a wheel rotatable about a substantially horizontal axis for rollingly supporting said chassis and rotatable about a vertical axis not co-linear with the vertical axis of another of said wheels for steering said chassis; and a wheel steering mechanism attached to said chassis including:

foot platform means for movement by a user's foot; and steering linkage means connecting said foot platform means to said wheels such that movement of said foot platform means steers said wheels.

17. The skateboard of claim 16 wherein:

each said wheel means includes a rollingly steerable support wheel having a substantially horizontal axle and each said wheel is rotationally mounted on its said axle.

18. The skateboard of claim 16 wherein:

said chassis includes:

a deck journal; and said wheel steering mechanism is rotationally mounted to said chassis deck journal.

19. The skateboard of claim 16 wherein:

said chassis has an underside that forms a plane circumscribing each said wheel such that obstacles from any direction can only strike each said wheel below each said wheel's horizontal axis.

20. The skateboard of claim 16 wherein:

each said wheel means steerable support wheel is rotatable about its said vertical axis through 360 degrees.

* * * * *